United States Patent [19]

Hull

[11] Patent Number: 4,976,646

[45] Date of Patent: Dec. 11, 1990

[54] MEDICINE PAL APPARATUS

[76] Inventor: Vickie D. Hull, 13102 Lookout Mtn. Ct., Houston, Tex. 77069

[21] Appl. No.: 425,287

[22] Filed: Oct. 23, 1989

[51] Int. Cl.[5] ..... A63H 3/00; A63H 3/52; A63H 3/14; B67D 5/00

[52] U.S. Cl. ..... 446/74; 446/267; 446/328; 446/372; 446/77; 222/78; D21/157

[58] Field of Search ..... 30/123, 124, 324; 446/26, 27, 227, 71, 72, 73, 74, 76, 77, 267, 268, 320, 327, 328, 329, 369, 370, 371, 372, 395; D21/157; 222/78; 221/24

[56] References Cited

U.S. PATENT DOCUMENTS

| | | | |
|---|---|---|---|
| D. 158,818 | 5/1949 | Titensky | D7/141 |
| D. 176,092 | 11/1955 | Allen | 446/73 X |
| D. 274,971 | 8/1984 | Kelley et al. | D21/157 X |
| D. 294,299 | 2/1988 | Woo | D24/63 |
| D. 294,390 | 2/1988 | Woo | D24/63 |
| D. 294,391 | 2/1989 | Woo | D24/63 |
| 1,627,166 | 5/1927 | Feldstein | 446/419 X |
| 2,457,270 | 12/1948 | Phillips | 446/292 |
| 2,506,719 | 5/1950 | Gregg | 221/24 |
| 2,698,996 | 1/1955 | Hickerson | 30/324 X |
| 2,787,055 | 4/1957 | Wertz | 30/123 |
| 2,795,043 | 6/1957 | Fleischer | 30/324 X |
| 3,105,612 | 10/1963 | Krasnoff et al. | 222/78 |
| 3,299,891 | 1/1967 | Smeton | 222/78 X |
| 3,448,539 | 6/1969 | Hartpence | 446/370 X |
| 3,839,792 | 10/1974 | Crapio | 30/120.1 |
| 3,854,478 | 12/1974 | Cunningham | 604/77 |
| 3,911,618 | 10/1975 | Gerst | 446/329 |
| 4,226,046 | 10/1980 | Delhome | 446/327 X |
| 4,719,702 | 1/1988 | Hoffman | 30/326 |
| 4,779,344 | 10/1988 | Panisch | 30/326 |

FOREIGN PATENT DOCUMENTS

| | | | |
|---|---|---|---|
| 477881 | 6/1929 | Fed. Rep. of Germany | 222/78 |
| 963263 | 7/1950 | France | 446/268 |
| 2387674 | 11/1978 | France | 446/370 |

*Primary Examiner*—Robert A. Hafer
*Assistant Examiner*—D. Neal Muir
*Attorney, Agent, or Firm*—Kirk & Lindsay

[57] ABSTRACT

In accordance with this invention there is provided a toy which engages a member such as a finger or a liquid medicine dispenser. The member acts as a lower jaw for the toy. The toy includes a head with an upper jaw and a body. The body is contiguous to the head and includes a trunk with front and rear limbs extended therefrom. Together, the upper jaw, the body, the front limbs and the rear limbs define a longitudinal passageway which passes through the toy. The toy accommodates the member in this passageway. The front limbs extending down from the front section of the trunk form a portion of the passageway which semi-positively engage the member. The rear limbs extending down from the rear portion of the trunk form a portion of the passageway which positively engage the member.

22 Claims, 3 Drawing Sheets

MEDICINE PAL APPARATUS

BACKGROUND OF THE INVENTION

The present invention generally relates to a toy, puppet or a holder for a liquid medicine dispenser for the entertainment of an infant or small child and, more particularly, is concerned with apparatus having the appearance of an animal with a passageway therethrough. The passageway accommodates the insertion of a liquid medicine dispenser for holding therein or for the insertion of a finger when the toy takes the form of a puppet or plaything.

Most young children or infants suffer minor sicknesses for which it is not uncommon to have prescribed various medicine in liquid form. Since many infants have an aversion to taking this medicine, the need exists for a toy to be used in conjunction with the dispensing of the medicine. The toy can also be played with at times other than when used with the medicine dispenser thus making its use less frightening.

The present invention adopts the basic finger puppet concept with the capability of minor animation. A finger placed within the hollow body of the toy becomes not only a support for the toy, but also, with minor dexterity, the finger tip becomes the animal's chin and lower jaw creating a puppet.

In instances involving very small fingers, it may be necessary to partially support the toy with the other free hand. As a finger puppet it allows the child to participate alone or with the parent, thus enhancing their interest, and through the imagination of the child and parents, the possibilities are limitless.

The act of slipping or snapping the toy or medicine pal on and off the medicine dispenser should be simple enough for a three year old child to accomplish since it could be fun for them. Children always enjoy doing things for themselves. The medicine pal may then be played with separate from the spoon since children should not play with medicine dispensers.

Most liquid medications for children are prescribed in dosages of 1 Tsp. or less until past the age of 7 years. It is also important to be able to see when and if the medicine has been taken entirely. Thus, it is important to see the 1 Tsp. line when the toy is on the dispenser. A toy with larger size and increased stability should also be helpful when the medicine is poured before bedtime ready to be given during the night.

Other figures have been designed in the past to fit over spoons for the feeding of children. Panisch U.S. Pat. No. 4,779,344 shows a FIG. 20 which sits on the handle of a spoon. The FIG. 20 either becomes permanently affixed to the spoon or is engaged by slits through the FIG. 20. The FIG. 20 also defines an index finger receiving channel which extends from an opening and terminates within the FIG. 20. The channel is to be used while the FIG. 20 is on the spoon. Hoffman U.S. Pat. No. 4,719,702 discloses a hand guard which fits over a utensil. The hand guard is held in place on the spoon by a channel or by an elastomeric strap 16 which grips the handle. Cunningham U.S. Pat. No. 3,854,478 discloses a guard which accepts a server with a calibrated stem. Various design patents for a medicine dosage spoon such as, U.S. Design Pat. Nos. 294,391, 294,390 and 294,299 to Woo and Kelley et al U.S. Design Pat. No. 274,971 disclose a medicine spoon which is designed as the shape of an ornamental figure.

The above-mentioned patents have a variety of shortcomings. None of the patents which take the form of an animated figure are designed to accommodate the several liquid medicine dispensers which are currently on the market. The patent to Cunningham which does accept a medication server is only functional in design and does not have any feature which will help in the psychology of serving an infant or a child. These inventions also do not include a passageway which allows a user's finger to function as the lower jaw of the figure nor do they act as a puppet separate from the utensil upon which they are mounted. From a psychological point of view, for an infant or a small child, it is desireable to have the mouth portion of the liquid medicine dispenser function as the lower jaw of an animal or character. It is also desirable to have the animal or character serve as a puppet or plaything when medicine is not being dispensed. These inventions also do not include features in addition to an animated figure to make an infant or small child comfortable with the device. It is desireable to include additional features such as a game as well as a message to put the infant or small child at ease when taking their medication. The message can be written on the character or it can be delivered by an adult who uses the puppet to talk to the child about taking medicine.

Therefore, it is an object of the invention disclosed herein to incorporate several features which will aid from a psychological point of view when dispensing liquids, semi-solids or solids to an infant or a child. Another object of the invention is to provide a toy to be used by the infant or child. It is also an object to provide a toy which will accommodate all of the liquid medicine dispensers which are currently on the market.

SUMMARY OF THE INVENTION

In accordance with this invention there is provided a toy which engages a member such as a finger or a liquid medicine dispenser. The member acts as a lower jaw for the toy. The toy includes a head with an upper jaw and a body. The body is contiguous to the head and includes a trunk, or body, with front and rear limbs extended therefrom. Together, the upper jaw, the trunk, the front limbs and the rear limbs define a longitudinal passageway which passes through the toy. The toy accommodates the member in this passageway. The front limbs extending down from the front section of the trunk form a portion of the passageway which semi-positively engage the member. The rear limbs extending down from the rear portion of the trunk form a portion of the passageway which positively engage the member.

DETAILED DESCRIPTION OF THE INVENTION

Figure 1:
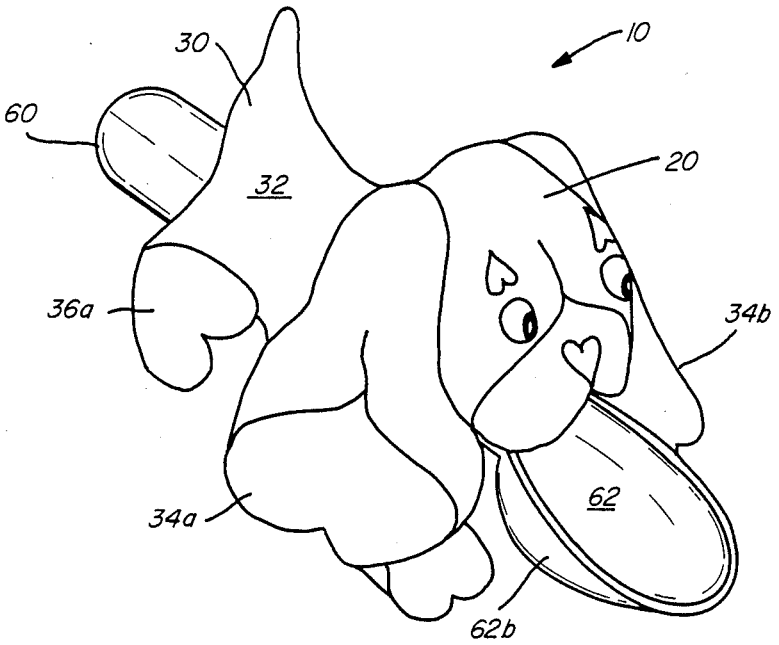
FIG. 1 is a front perspective view of a first embodiment of the present invention shown holding a typical liquid medicine dispenser.
Figure 2:
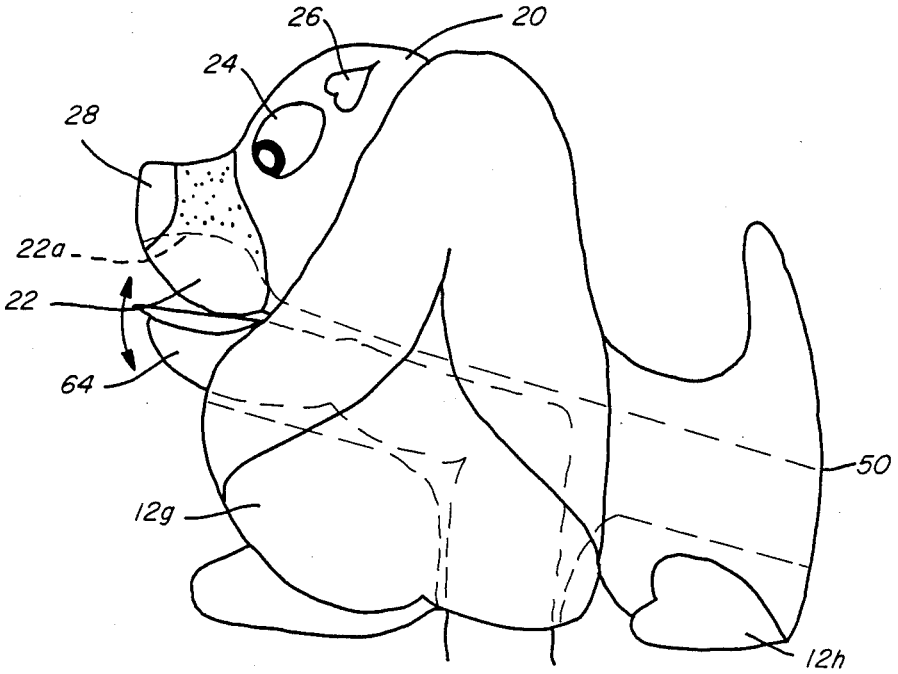
FIG. 2 is a longitudinal side view of the toy with a finger inserted in the L-shaped configuration.

Referring to FIG. 1, a toy or puppet 10 called a "medicine pal" is shown. The toy preferably takes the form of an animal which as shown is a dog. However, the toy 10 may also take the shape of a frog, bear, pig, turtle as well as a variety of other forms. These forms may be other animals such as reptiles and dinosaurs as well as forms such as plants, fruits, etc. The variety of forms that the toy 10 may take is limited only by the imagination of the designer. The toy 10 generally includes a head 20, and a body 30. The head 20 and body 30 define a longitudinal passageway 50 which extends through the toy 10. This longitudinal passageway 50 is formed to accept and engage a member 60 such as a graduated liquid medicine dispenser 62. If the liquid medicine dispenser 62 is removed, the passageway 50 will accept another member 60 such as a finger 64 as shown in FIG. 2 or a liquid medicine dispenser cup (not shown). A medicine spoon dispenser 62, finger 64, or any other member which is inserted into the toy 10, will function as the lower jaw of the toy 10.

The toy 10 accommodates many different brands of liquid medicine dispensers 62. While other dispensers may easily be accommodated, examples of useful brands of liquid medicine dispensers currently on the market is as follows:

| NAME | OWNER |
|---|---|
| 1. "PEEDEE" dose medicine spoon | MEDI-AID CORPORATION |
| 2. "APEX" medicine spoon | "APEX" MEDICAL CORPORATION |
| 3. "EZY DOSE" hook spoon | APOTHECARY PRODUCTS INC. |
| 4. "THE FIRST YEARS" | THE FIRST YEARS |
| 5. medicine dosage spoon | HEALTH ENTERPRISES INC. |
| 6. "EVENFLO" | EVENFLO PRODUCTS CO. |
| 7. "EZY DOSE" spoon | APOTHECARY PRODUCTS INC. |
| 8. spill proof spoon | PFIZER |
| 9. "CRIB PALS" medicine feeder | GEOFFREY INC. |
| 10. "EZY INFANT CARE" | APOTHECARY PRODUCTS, INC. |
| 11. "EZY DOSE" with no spill cap | APOTHECARY PRODUCTS, INC. |
| 12. "MEDI-FEEDER" | SAFETY FIRST, INC. |
| 13. "PLAYSKOOL" medicine spoon | PLAYSKOOL BABY, INC. |

Figure 3:
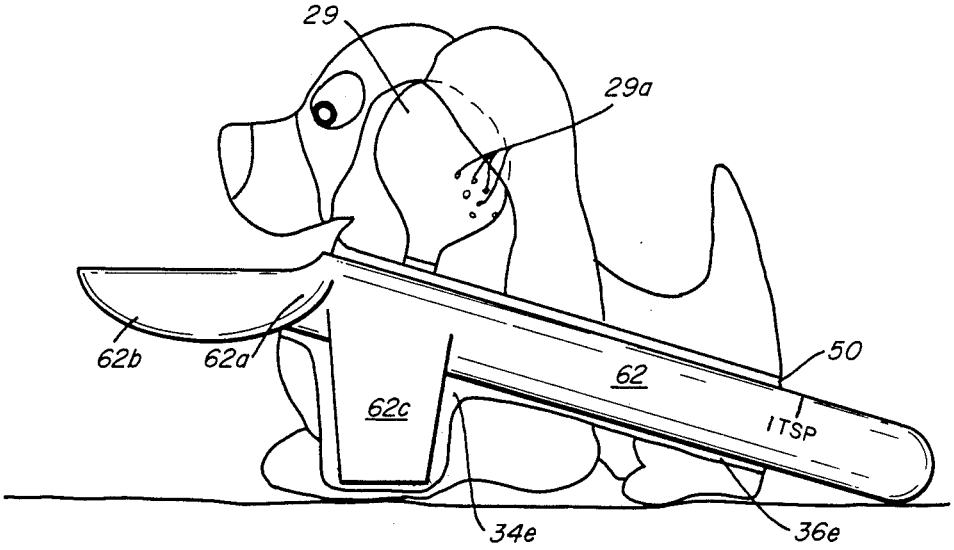
FIG. 3 is a longitudinal side view of the toy with cutaways showing the passageway and the hollow region in the head.
Figure 4:
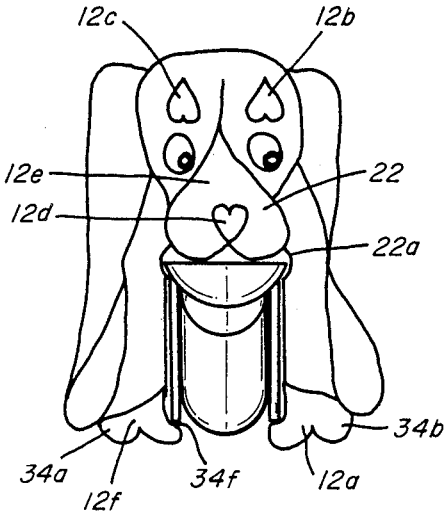
FIG. 4 is a view from the front of the toy.

The toy 10 fits all styles of the liquid medicine dispenser 62. All but three of the most commonly available medicine dispensers are similar in design. In one case, "THE FIRST YEARS" dispenser, the somewhat larger stand or support legs **62*c* require a special molding recess or ledge 34*f*, as shown in FIG. 4, that would allow an ease of fit for this specific dispenser. The "APEX MEDICINE SPOON" has the stand support 62C towards the front, closer to the mouth 62*b* of the dispenser 62. The "MEDI-FEEDER" dispenser would require a larger passageway 50 to accommodate its oval shape. All dispensers have structures similar to that shown in FIG. 3. With some modification in the passageway 50, the toy 10** could be adopted to fit around the perimeter of a liquid medicine dispenser cup.

Figure 6:
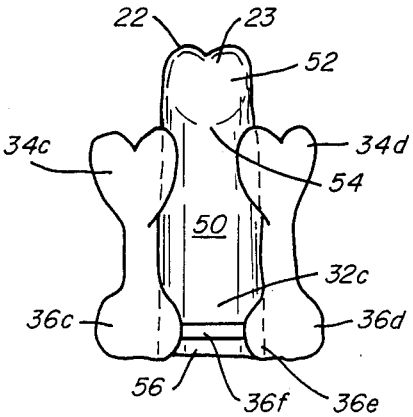
FIG. 6 is a bottom view of the toy.

As shown in FIG. 2, the head 20 includes an upper jaw 22, eyes 24, eyebrows 26, a nose 28, as well as any other desirable facial features. Referring to FIG. 6, the upper jaw 22 defines the front portion 52 of the passageway 50. The upper jaw 22 has a curved underside 23 which defines or bounds this front portion 52 of the passageway 50. This surface 23 will cover an arc of approximately 180° so that the upper jaw can accommodate liquid medicine dispensers 62 of various sizes. As shown in FIG. 4 the upper jaw 22 may have a slightly greater arc **22*a* for supporting the rear portion 62*a* of the mouth 62*b* of the liquid medicine dispenser 62. The upper jaw 22 should be short enough so that the mouth 62*b* of the dispenser 62 protrudes a sufficient distance for dispensing medicine to an infant. In one example the upper jaw 22 would protrude no further than ½-inch. As shown in FIG. 3, the head 20 may be formed with a hollow region 29 to be filled with particulate matter 29*a*. The particulate matter 29*a* can be enclosed or sealed within this hollow region 29 such that the toy 10** can act as a rattle.

As shown in FIG. 1, the body 30 includes a trunk 32 front limbs **34*a* and 34*b* and rear limbs 36*a* and 36*b* (not shown). The body 30 is contiguous to the head 20. Referring to FIG. 6, the trunk 32, the front limbs 34 and the rear limbs 36 together define or bound the mid 54 and rear 56 portions of the passageway 50. The bottoms 34*c*, 34*d*, 36*c* and 36*d* of the front and rear limbs 34 and 36 are flat so that the toy 10 will have stability when placed on a surface. The passageway 50 is longitudinal to the plane including the bottoms 34*c*, 34*d*, 36*c* and 36*d* of the limbs 34 and 36 so that when the liquid medicine dispenser 62 is held by the toy 10 while standing on a flat horizontal surface, the medicine will not spill from the dispenser 62. The longitudinal passageway or channel 50 should be at an angle greater than 5° from the plane containing the bottoms 34*c*, 34*d*, 36*c* and 36*d* of the limbs 34 and 36 so that medicine will not be spilled if the toy 10 is accidentally bumped or jarred. The length of the passageway 50 from front 52 to rear 56 is preferably no longer than three inches so that the toy 10 does not cover the one teaspoon line on the liquid medicine dispenser 62**.

The front limbs **34*a* and 34*b* may be either front legs 34*a* and 34*b* or may be ears 34*a* and 34*b*. These front limbs 34*a* and 34*b* form sides 54*a* and 54*b* of the mid portion 54 of the passageway 50. The inner surface 34*e* of the limbs 34 together with the underside of the trunk 32 form a smooth arcuate surface which is preferably greater than 180° but less than 288°. As such, the mid portion 54 of the passageway 50 will preferably encircle between 50 and 80% of the member 60 to be inserted in the toy 10. The member 60 can either be slid through the mid portion 54 of the passageway 50 or if the toy 10 is made of a flexible material, the member 60 can be snapped up into the mid portion 54 of the passageway 50. This mid portion 54 of the passageway 50 defines a semi-positive engagement region as it allows both longitudinal and latitudinal motion of a liquid dispenser 62. As previously mentioned some of the dispensers 62 have larger tabs or stands 62c than others. When the dispenser 62 is held by the toy 10 this tab 62c will be in the mid portion 54 of the passageway 50. As such, the front limbs 34 must also allow enough room to accommodate the largest tab 62c. The top surface of the front limbs 34 includes ledge 34f which will support the larger tab or stand 62c of "THE FIRST YEARS" dispenser once it is inserted into the toy 10**.

Figure 5:
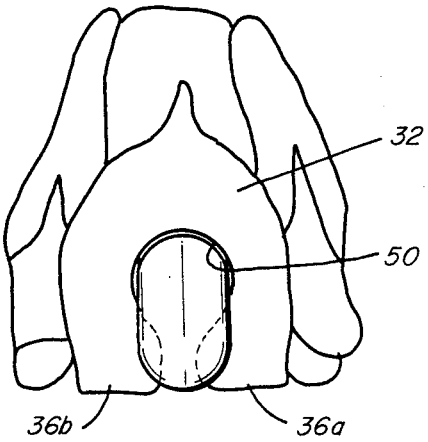
FIG. 5 is a view from the rear portion of the toy.

As shown in FIG. 5, the rear limbs 36a and 36b comprise two rear legs 36a and 36b which extend downward from the trunk 32. The rear portion 56 of the passageway 550 is defined by the lower surface 32c of the trunk 32 and the inner surface 36e of the rear limbs 36a and 36b. Together, these surfaces 32c and 36e form a smooth continuous arcuate surface which is greater than 180° and preferably greater than 288°. As such, a member inserted through the rear portion 56 of the passageway 50 will be greater than 50% encircled. As shown in FIG. 6, a band 36f may connect the rear limbs 36a and 36b to continue the arc so that the passageway will be 100% encircled at rear portion 56. This rear portion 56 of the passageway 50 defines a positive engagement region of the passageway 50. This positive engagement allows longitudinal motion of a liquid dispenser 62 but restricts latitudinal motion for a snug positive engagement of the various liquid medicine dispensers 62 on the market.

As shown in FIG. 2, cavity 22a within the upper jaw 22 of the toy 10 should be constructed in a way that allows the finger tip 64 to partially recess within the upper jaw 22 thus allowing more freedom of movement, and a more realistic lower jaw appearance. A user of the puppet could color their fingernail red to simulate the tongue or mouth of the puppet 10.

The puppet 10 is designed to fit many finger sizes, adult, as well as, young children. Through balanced construction, a very small child around age three can work the toy 10 as a puppet by means of an L-shaped finger arrangement while older participants or participants with large hands have the ability to work the toy 10 with a finger 64 in a straight trough the passageway 50 arrangement. A user with a small hand will be able to use the L-shaped finger arrangement by sticking their finger 64 between the front and rear limbs 34 and 36 as shown in FIG. 2.

Since the boundaries of passageway 50 boundaries are designed to accommodate and hold the various liquid medicine dispensers 62 on the market, the passageway 50 may have an arc which starts at the jaw with a larger radius tapering to a smaller radius which at the rear portion 56 is not less than ¼-inch. The radius of the arc of the passageway 50 may be the same throughout or may have an uneven taper. However, the radius should preferably never be less than ¼-inch throughout the passageway. When using the "MEDI-FEEDER" dispenser, the passageway 50 must be larger with a radius of at least ½-inch. If using a medicine cup, the passageway 50 must be larger to accommodate the perimeter of the cup.

In a preferred embodiment the toy 10 will include ten symbols 12 which as shown in FIGS. 2 and 4 are hearts 12a through 12j (12i and 12j not shown) located at various locations on the toy 10. These symbols 12 are an added interest and learning feature in the form of a game that can be used to reinforce the recognition and differentiation of basic shapes, as well as, a practical counting game. On each different toy 10 there will preferably be ten of the basic shapes, one shape per toy 10.

Some of these shapes will be large, obvious, and appear exactly like the typical object. Others will appear less obvious, smaller, and possibly disoriented, (i.e. upside down, sideways, fat, thin, etc.) Finding the shapes on the toy 10 and counting them will be the games involved.

Figure 7A:
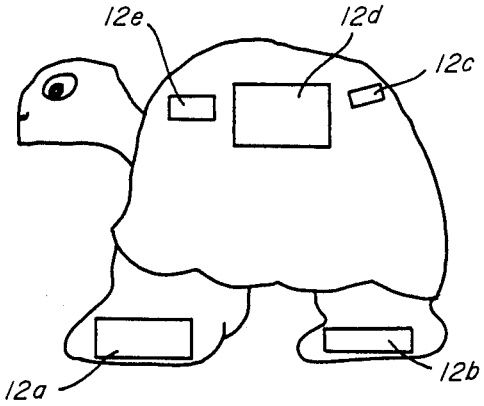
FIG. 7A is a longitudinal side view of another embodiment of the toy.
Figure 7B:
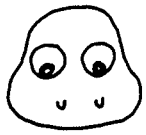
FIG. 7B is a view of the face of the toy shown in FIG. 7A.
Figure 8B:
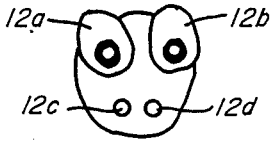
FIG. 8B is a view of the face of the toy shown in FIG. 8A.
Figure 8A:
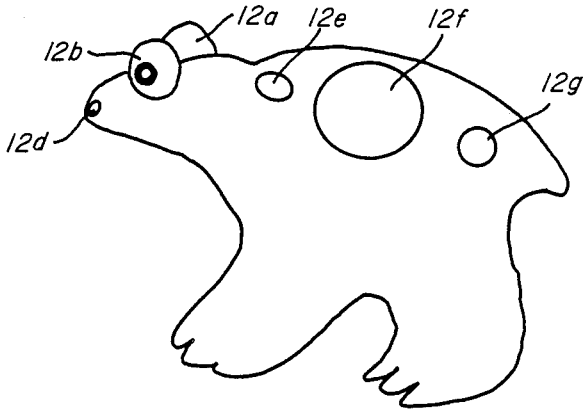
FIG. 8A is a longitudinal side view of another embodiment of the toy.
Figure 9A:
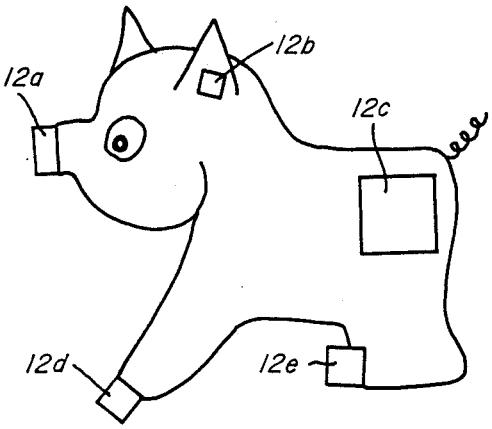
FIG. 9A is a longitudinal side view of another embodiment of the toy.
Figure 9B:
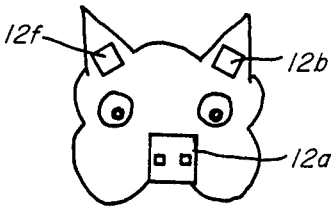
FIG. 9B is a view of the face of the toy shown in FIG. 9A.
Figure 10B:
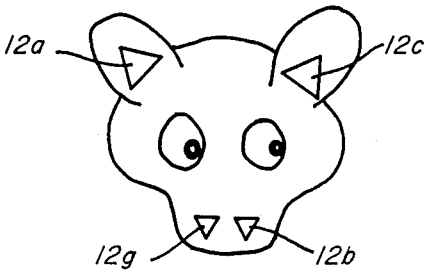
FIG. 10B is a view of the face of the toy shown in FIG. 10A.
Figure 10A:
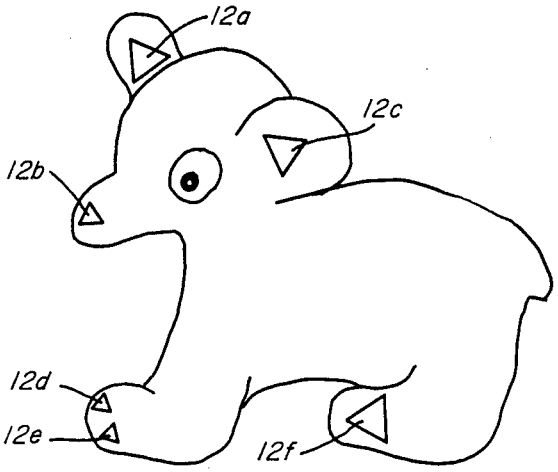
FIG. 10A is a longitudinal side view of another embodiment of the toy.

The total number of ten is chosen because our math system is based on ten. The actual number of ten should not be mentioned because every answer should be the correct answer. Since the reasoning ability of a three year old is very different from that of a seven year old, each animal has one shape 12 in its design to isolate that shape and make it easy to learn. The symbols may be other objects such as hearts, circles, triangles, squares, rectangles, etc. These are the first basic shapes that a child recognizes. Preferably, the dog will have the hearts, the turtle, as shown in FIGS. 7A and 7B, will have the rectangles, the frog, as shown in FIGS. 8A and 8B, will have the circles, the pig, as shown in FIGS. 9A and 9B, will have the squares and the bear, as shown in FIGS. 10A and 10B, will have the triangles. The symbols may also take the form of a message. Each animal may have a different surprise message such as, "get well soon", "I love you", "I'm your pal", "get beary well", and "pigs are pals". The message may be placed on the ear 34 and may be covered by a flaccid flap. One of the first steps in reading is learning letters and learning to say words together. Another message, such as "I am a medicine pal when you are sick and I am a finger puppet when you are well," may also be used with the medicine pal 10 to give the child the idea that being sick is only temporary.

Since the toy 10 is to be used for and by infants, it is designed for safety. All surfaces of the toy 10 are obtuse or blunt so that an infant will not be injured. The toy 10 is preferably made from plastic or another suitable sturdy and durable, but flexible material Some examples of suitable non-toxic materials are latex or polyurethane. The toy 10 is also large enough to prevent an infant from swallowing or choking on the toy 10.

The preferred embodiment of this invention has been shown and described above and it is to be understood that minor changes in the details in construction and arrangement of the parts may be made without departing from the spirit or scope of the invention as claimed.

What is claimed is:

1. A toy for holding a medicine spoon, a medicine cup or a finger, comprising:

a head having an upper jaw;

a body contiguous with said head, said body having front and rear limbs;

said upper jaw and said body defining a longitudinal passageway through which a medicine spoon, a medicine cup, or a finger can be placed to function as a lower jaw of the toy; said front limbs extending down from a front portion of said body being spread apart to form a forward means for loosely engaging a medicine spoon, a medicine cup or a finger thereby forming a bottom open passageway; and said rear limbs extending down from a rear portion of said body and being spread apart to form a rearward means for firmly engaging around a medicine spoon or a medicine cup.

2. The toy according to claim 1, wherein said longitudinal passageway slops downward from said upper jaw through said front limbs and said front portion of said body to said rear limbs and said rear portion of said body, said passageway having a smooth arcuate surface.

3. The toy according to claim 2, wherein the radius of said arcuate surface of said passageway is greater than ¼-inch.

4. The toy according to claim 2, wherein the diameter of said arcuate surface of said passageway secures a medicine spoon, a medicine cup or a finger.

5. The toy according to claim 1, wherein said front limbs comprise front legs and said rear limbs comprise rear legs.

6. The toy according to claim 1, wherein said front limbs comprise ears and said rear limbs comprise rear legs.

7. The toy according to claim 1, further comprising identifiable symbols located at various locations on said head and said body of said toy.

8. The toy according to claim 1, wherein the length of said toy from said upper jaw to the rear portion of said body is less than three inches.

9. The toy according to claim 1, wherein said rearward means for firmly engaging is formed by said rear limbs which wrap around more than 50% of the circumference of a medicine spoon, a medicine cup or a finger and wherein said forward means for loosely engaging is formed by said front limbs which wrap around approximately 50% of the circumference of a medicine spoon, a medicine cup or a finger.

10. The toy according to claim 1, wherein said front limbs and said upper jaw include supporting means capable of accommodating and supporting a medicine spoon, a medicine cup or a finger.

11. The toy according to claim 1, wherein said head has a hollow region filled with a particulate matter to form a rattle.

12. A toy to be used as a puppet, a game and for holding a liquid medicine spoon wherein said toy engages a mid-portion of the dispenser using a mouth of a liquid medicine spoon for a lower jaw and wherein a rear portion of a liquid medicine spoon below a 1 Teaspoon line is unobstructed by said toy, said toy comprising:

a figure having a head with an upper jaw, a trunk and front and rear limbs;

said figures having a bottom open longitudinal passageway through which a medicine spoon can be placed to allow a medicine spoon to function as a lower jaw of the toy, where the passageway is defined by said upper jaw, said trunk and said front and rear limbs; said upper jaw defining a front portion of said passageway and being adapted to support and accommodate the mouth of a liquid medicine dispenser;

said trunk defining an upper surface of a mid and a rear portion of said passageway; said front limbs defining the sides of the mid portion of said passageway comprising a forward means for loosely engaging a liquid medicine spoon; said front limbs placed far enough apart to accommodate liquid medicine spoons with various sized tabs;

said rear limbs defining the sides and lower portion of the rear portion of said passageway comprising a rearward means for firmly engaging a liquid medicine spoon.

13. The toy according to claim 12, wherein said passageway slopes downward from said upper jaw through said front limbs and said front portion of said body to said rear limbs and said rear portion of said body, said passageway having a smooth arcuate surface.

14. The toy according to claim 13, wherein the diameter of said arcuate surface of said passageway accommodates a liquid medicine dispenser.

15. The toy according to claim 12, wherein said front limbs comprise front legs and said rear limbs comprise rear legs.

16. The toy according to claim 12, wherein said front limbs comprise ears and said rear limbs comprise rear legs.

17. The toy according to claim 12, further comprising identifiable symbols located at various locations on said head and said body of said puppet.

18. The toy according to claim 12, wherein the length of said toy from said upper jaw to the rear portion of said body is less than three inches.

19. The toy according to claim 12, wherein said rearward means for firmly engaging is formed by said rear limbs which wrap around more than 50% of the circumference of a liquid medicine spoon and wherein said forward means for loosely engaging is formed by said front limbs which wrap around approximately 50% of the circumference of a liquid medicine spoon.

20. The toy according to claim 12, wherein said front limbs and said upper jaw include supporting means capable of accommodating and supporting a liquid medicine spoon.

21. The toy according to claim 12, wherein said head has a hollow region filled with a particulate matter to form a rattle.

22. A toy in combination with a medicine spoon comprising:

a medicine spoon having a mouth and a rear portion for dispensing medicine;

a head having an upper jaw and having a void where a lower jaw would be located;

a body contiguous with said head, said body having front and rear limbs;

said upper jaw and said body defining a bottom open longitudinal passageway through which said medicine spoon can be placed to orient the mouth of the spoon to function as a lower jaw of the toy;

said front limbs extending down from a front portion of said body being spread apart to form a forward means for loosely engaging said medicine spoon; and said rear limbs extending down from a rear portion of said body and being spread apart to form a rearward means for firmly engaging said medicine spoon.

* * * * *